US012757935B2

(12) United States Patent
Wolf et al.

(10) Patent No.: US 12,757,935 B2
(45) Date of Patent: Oct. 13, 2026

(54) AEROSOL GENERATION DEVICE

(71) Applicant: JT International SA, Geneva (CH)

(72) Inventors: Christina Wolf, Klagenfurt (AT); Moritz Werny, Munich (DE); Philipp Hans Refior, Munich (DE); Akira Yamaguchi, Geneva (CH); Ryo Hasegawa, Geneva (CH); Layth Sliman Bouchuiguir, Bellevue (CH); Yusuke Kayama, Tokyo (JP)

(73) Assignee: JT International SA, Geneva (CH)

( * ) Notice: Subject to any disclaimer, the term of this patent is extended or adjusted under 35 U.S.C. 154(b) by 708 days.

(21) Appl. No.: 18/030,195

(22) PCT Filed: Sep. 16, 2021

(86) PCT No.: PCT/EP2021/075477
§ 371 (c)(1),
(2) Date: Apr. 4, 2023

(87) PCT Pub. No.: WO2022/073739
PCT Pub. Date: Apr. 14, 2022

(65) Prior Publication Data

US 2023/0363449 A1 Nov. 16, 2023

(30) Foreign Application Priority Data

Oct. 6, 2020 (EP) ..... 20200356

(51) Int. Cl.
*A24F 40/42* (2020.01)
*A24F 40/20* (2020.01)

(52) U.S. Cl.
CPC ..... *A24F 40/42* (2020.01); *A24F 40/20* (2020.01)

(58) Field of Classification Search
None
See application file for complete search history.

(56) References Cited

U.S. PATENT DOCUMENTS 5,338,922 A * 8/1994 Kim ..... F24C 15/162 219/521
2016/0050975 A1 2/2016 Worm et al.
(Continued)

FOREIGN PATENT DOCUMENTS

EP 3167728 A1 5/2017
JP 2017532009 A 11/2017
(Continued)

OTHER PUBLICATIONS

International Search Report for PCT/EP2021/075477 mailed Nov. 26, 2021. 3 pgs.

*Primary Examiner* — Philip Y Louie
*Assistant Examiner* — John Mitchell Martin
(74) *Attorney, Agent, or Firm* — Lerner David LLP

(57) ABSTRACT

The present disclosure relates to an aerosol generation device in which an aerosol generating substrate is heated to form an aerosol. More specifically, an aerosol generation device comprises: an aerosol generation chamber configured to receive and heat a substrate to generate aerosol, the aerosol generation chamber comprising at least a heating element; cover which can be in a closed position covering an aperture in the device, and in an open position exposing said aperture; and a tray for receiving and holding the substrate.

19 Claims, 4 Drawing Sheets

(56) References Cited

U.S. PATENT DOCUMENTS

| | | | | |
|---|---|---|---|---|
| 2018/0049472 | A1* | 2/2018 | Mahler | A24F 40/46 |
| 2018/0297048 | A1 | 10/2018 | Ricketts et al. | |
| 2021/0015151 | A1 | 1/2021 | Tanaka | |
| 2021/0145050 | A1 | 5/2021 | Ricketts et al. | |
| 2021/0315282 | A1 | 10/2021 | Plevnik et al. | |
| 2022/0202072 | A1* | 6/2022 | Wei Yim | A24F 40/40 |
| 2023/0094447 | A1* | 3/2023 | Gawdiak-Smyth | A24F 40/30 128/202.21 |
| 2023/0235834 | A1* | 7/2023 | Hielscher | F16K 1/50 251/61.2 |

FOREIGN PATENT DOCUMENTS

| | | | |
|---|---|---|---|
| JP | 2018523986 | A | 8/2018 |
| JP | 2019180393 | A | 10/2019 |
| JP | 2020115822 | A | 8/2020 |
| JP | 2021520799 | A | 8/2021 |
| JP | 2022504951 | A | 1/2022 |
| WO | 2019202048 | A1 | 10/2019 |
| WO | 2020079226 | A1 | 4/2020 |

* cited by examiner

AEROSOL GENERATION DEVICE

CROSS-REFERENCE TO RELATED APPLICATIONS

The present application is a national phase entry under 35 U.S.C. § 371 of International Application No. PCT/EP2021/075477, filed Sep. 16, 2021, published in English, which claims priority to European Application No. 20200356.2 filed Oct. 6, 2020, the disclosures of which are incorporated herein by reference.

FIELD OF THE INVENTION

The present disclosure relates to an aerosol generation device in which an aerosol generating substrate is heated to form an aerosol. The disclosure is particularly applicable to a portable aerosol generation device, which may operate at low temperature. Such devices may heat, rather than burn, tobacco or other suitable aerosol substrate materials by conduction, convection, and/or radiation, to generate an aerosol for inhalation.

BACKGROUND

The popularity and use of aerosol generation devices (also known as e-cigarettes and heat-not-burn products) has grown rapidly in the past few years. Various devices and systems are available that heat or warm aerosolisable substances as opposed to burning tobacco in conventional tobacco products.

Devices of this type generate an aerosol or vapour by heating an aerosol substrate that typically comprises moist leaf tobacco or other suitable solid aerosolisable material to a temperature typically in the range 150° C. to 350° C. Heating such an aerosol substrate, but not combusting or burning it, releases an aerosol that comprises the components sought by the user but not the toxic and carcinogenic byproducts of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user. In such devices, the aerosol substrate is heated by a heating element, for example in a heating chamber. The aerosol substrate is consumed through generation of the aerosol and must be regularly replaced. It is therefore desirable to provide a convenient way of replacing the aerosol substrate in the heating chamber.

Additionally, it is desirable to generate more aerosol from a given quantity of aerosol substrate, and therefore it is desirable to provide a device that can heat the aerosol substrate to generate aerosol more efficiently.

SUMMARY OF THE INVENTION

According to a first aspect, the following disclosure provides an aerosol generation device comprising: An aerosol generation chamber configured to receive and heat a substrate to generate aerosol, the aerosol generation chamber comprising at least a heating element; a cover which can be in a closed position covering an aperture in the device, and in an open position exposing said aperture; and a tray for receiving and holding the substrate, wherein when the cover is in the open position, the tray is located underneath the aperture such that a substrate can be received or a substrate held by the tray can be removed by the hand of the user, and when the cover is in the closed position, a substrate received and held by the tray is contained in the aerosol generation chamber and in contact with the heating element; the cover can be translated from the open position to the closed position by translating the cover over the aperture, whereby the tray is translated such that a substrate held by the tray is translated into the aerosol generation chamber and put in contact with the heating element.

The tray provides an intuitive and robust way to replace the aerosol substrate consumable by removing a used substrate from the tray and putting an unused substrate on the tray through the aperture in the housing. By closing the lid over the aperture, the substrate is then moved into the aerosol generation chamber, providing a simple and intuitive way for a user to place the substrate in the right position. Additionally, by movement of the tray into the aerosol generation chamber, the substrate is put in contact with the heating element, thereby improving aerosol generation efficiency.

Optionally, the translation of the tray comprises a translation in a direction parallel to a longitudinal direction of an oblong housing of the aerosol generation device.

The translation in the direction parallel to the longitudinal direction of the housing allows for a longer translation, which allows for a larger substrate surface area and therefore higher aerosol generation efficiency.

Optionally, the tray is connected to the cover in a manner which fixes the position of the tray relative to the cover in the longitudinal direction of housing, so that the translation of the cover in the longitudinal direction of the housing results in a translation of the tray in the longitudinal direction of the housing.

This allows for an ergonomic and intuitive handling by a user: the tray with the substrate is moved when sliding the cover over the aperture, automatically putting the substrate in the right position relative to the heating element.

Optionally, the tray is connected to the cover in a manner which fixes the position of the tray relative to the cover in a direction perpendicular to the longitudinal direction of the housing, so that a translation of the cover in the direction perpendicular to the longitudinal direction of the housing results in a translation of the tray in a direction perpendicular to the longitudinal direction of the housing.

This provides haptic feedback to the user as to where the substrate is located and whether the substrate is already fully located in the aerosol generation chamber, thereby improving intuitive handling.

Optionally, the tray comprises at least two bolts configured to be placed inside a guide rail.

This allows for the tray to be guided along a specific track along a guide rail, which improves intuitive handling and ensures the correct positioning of the substrate relative to the heating element, thereby improving aerosol generation efficiency.

Preferably, each of the bolts consists of or comprises a pair of substantially cylindrical studs.

Providing two studs on the sides of the tray rather than one continuous bolt extending from both sides of the tray reduces material usage and improves the device's cost efficiency.

Preferably, the bolts are arranged on the tray distanced from each other, preferably one bolt being arranged in front of the substrate and one bolt being arranged behind the substrate in the insertion direction.

This allows for good controllability of the tray's position within the guide rail by means of a long lever. In particular, the orientation of the tray in the direction substantially parallel to the guide rail can be precisely controlled.

Optionally, the bolts' diameters are at most thrice the thickness of the tray, preferably at most twice the thickness of the tray, more preferably not larger than the thickness of the tray.

Small studs improve the ability of a tray to move through the guide rail and therefore makes the handling of the device easier for a user.

Optionally, the tray is guided between the open and the closed position by a guide rail configured to receive at least part of bolts.

This allows for exact control of the distance of the tray to the heating element. Thus, aerosol generation efficiency can be improved.

Optionally, the guide rail has a first portion and a second portion, the first portion being located underneath the aperture and the second portion being located underneath the heating element, the first portion having a first distance to a level of the heating element and the second portion having a second distance to a level of the heating element, the second distance being smaller than the first distance.

The two distances of the guide rail from the heating element area forces the tray and therefore the substrate to get closer to the heating element as the tray moves into the aerosol generation chamber. Eventually, the substrate can be pressed against the heating element, which ensures continuous contact between the substrate and the heating element during consumption of the substrate. This improves the aerosol generation efficiency.

Optionally, in the closed position, both bolts are located in the second portion of the guide rail.

If both bolts are located in the second portion of the guide rail, both bolts hold the substrate in a position close to the heating element. Therefore, both ends of the substrate can be pressed against the heating element. By pressing the substrate towards the heating element, the aerosol generation efficiency is improved.

Optionally, the aerosol generation device comprises a second guide rail, also having a first portion and a second portion, the first portion being located underneath the aperture and the second portion being located underneath the heating element, the first portion having a first distance to a level of the heating element and the second portion having a second distance to a level of the heating element, the second distance being smaller than the first distance, the second guide rail being located spaced from the first guide rail in the longitudinal direction of the housing.

Two guide rails in the housing improve stability of the tray and ensure that the substrate is properly pressed towards the heating element. The second guide rail provides a second fixpoint in addition to the first guide rail, which ensures that the substrate is held parallel to the heating element. If only one guide rail is provided, only one edge of the substrate may be in contact with the heating element, whereas if a second guide rail brings a second, opposite edge of the substrate in contact with the heating element, the whole surface of the substrate may be pressed towards the heating element, whereby aerosol generation efficiency is improved.

Optionally, at least one bolt is placed in the first guide rail and at least one bolt is placed in the second guide rail.

This improves stability of the tray and ensures that the substrate is properly pressed towards the heating element, thereby improving aerosol generation efficiency.

Optionally, the tray comprises a recess, configured to receive and hold the substrate.

A recess in the tray secures the substrate on the tray and prohibits movement of the substrate relative to the tray during translation of the tray into the aerosol generation chamber. This ensures that the substrate can be brought into the correct position relative to the heating element, and aerosol generation efficiency is improved.

Optionally, the substrate has the shape of a plate, pad or disk.

A substrate having such a shape is substantially flat and can easily be put in contact with a substantially flat heating element, ensuring permanent contact and improving aerosol generation efficiency. Also, the ratio between the surface in contact with the heating element and the volume of the substrate is relatively large, thereby further increasing aerosol generation efficiency.

DETAILED DESCRIPTION OF PREFERRED EMBODIMENTS

Figure 1:
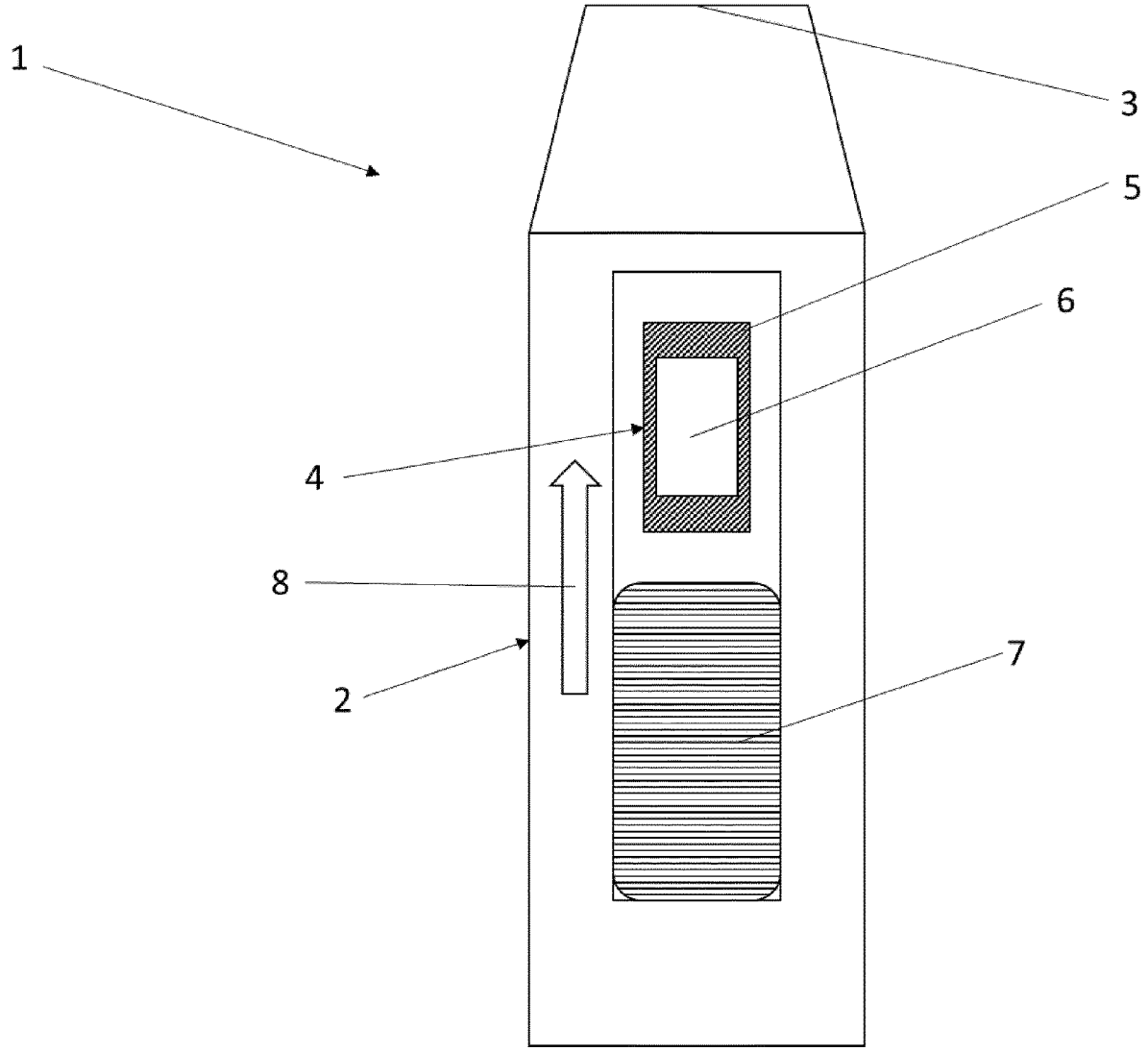
FIG. 1 shows the aerosol generation device in top view, with the cover in open position.

In the following, preferred embodiments of the present invention will be described in detail with reference to the accompanying drawings. In the description of the drawings, the same or similar reference numerals denote the same or similar pails. It should be noted that the drawings are schematic, and the ratios of dimensions and the like may be different from the actual ones.

The aerosol generation device 1 is configured to work with a substantially cuboid substrate 11, preferably having a flat shape. In a typical example, the size of the substrate 11 is 18×12×1.2 mm. Generally, the length of the substrate in the preferred embodiments is between 40 and 10 mm, preferably between 30 and 12 mm, more preferably between 25 and 14 mm, and most preferably between 22 and 15 mm. The width of the substrate in the preferred embodiments is between 30 and 6 mm, preferably between 25 and 8 mm, more preferably between 20 and 9 mm, and most preferably between 16 and 9 mm. The height of the substrate in the preferred embodiments is between 3 and 0.5 mm, preferably between 2 and 0.6 mm, more preferably between 1.8 and 0.8 mm, and most preferably between 1.6 and 0.9 mm.

The aerosol substrate may for example comprise nicotine, tobacco and/or an aerosol former. Tobacco may take the form of various materials such as shredded tobacco, granulated tobacco, tobacco leaf and/or reconstituted tobacco. Suitable aerosol formers include: a polyol such as sorbitol, glycerol, and glycols like propylene glycol or triethylene glycol; a non-polyol such as monohydric alcohols, acids such as lactic acid, glycerol derivatives, esters such as triacetin, triethylene glycol diacetate, triethyl citrate, glycerin or vegetable glycerin. In some embodiments, the aerosol generating agent may be glycerol, propylene glycol, or a mixture of glycerol and propylene glycol. The substrate may also comprise at least one of a gelling agent, a binding agent, a stabilizing agent, and a humectant. The aerosol substrate may be porous such that air can flow through the substrate and collect aerosol as it does so. The substrate may for example be a foam, or packed strands or fibres. The substrate may be formed through an extrusion and/or rolling process into a stable shape. The aerosol generating substrate may be shaped to provide one air flow channel or multiple air flow channels. These can be aligned with the air flow channel of the aerosol generating device in order to increase air flow through the heating chamber. The substrate is exposed with a bare external surface. Alternatively, the substrate may comprise an air-permeable wrapper covering at least part of a surface of the aerosol generating substrate. The wrapper may, for example, comprise paper and/or non-woven fabric.

The aerosol generation chamber 15 may simply be an interior volume of the housing 2, but the aerosol generation chamber 15 is preferably enclosed by an insulating enclosure within the housing 11, so that additional components such as control circuitry and an electrical power source (not shown) are insulated from heat provided within the aerosol generation chamber 15. The housing may generally be made from any rigid material such as a thermoplastic or a metal (e.g. aluminium). The insulating enclosure may be made from a heat-resistant material such as polyethylene terephthalate (PET), polybutylene terephthalate (PBT), or polyamide (PA) in order to prevent thermal deformation or melting. The heat resistant material may be a super engineering plastic such as polyimide (PI), polyphenylenesulfide (PPS) or polyether ether ketone (PEEK).

Figure 3:
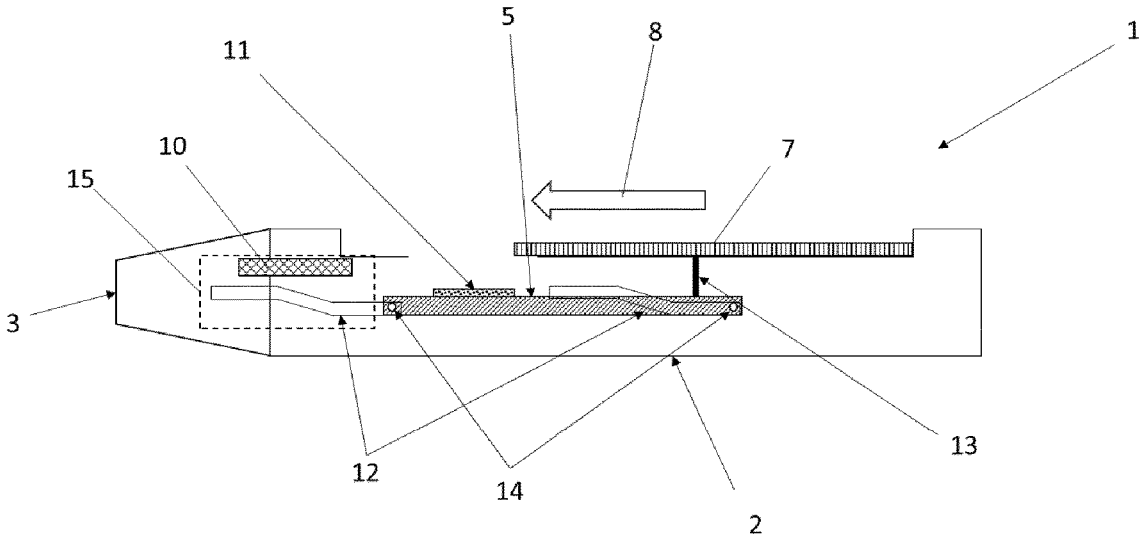
FIG. 3 shows a cross-sectional view of the aerosol generation device, with the cover in open position.
Figure 6:
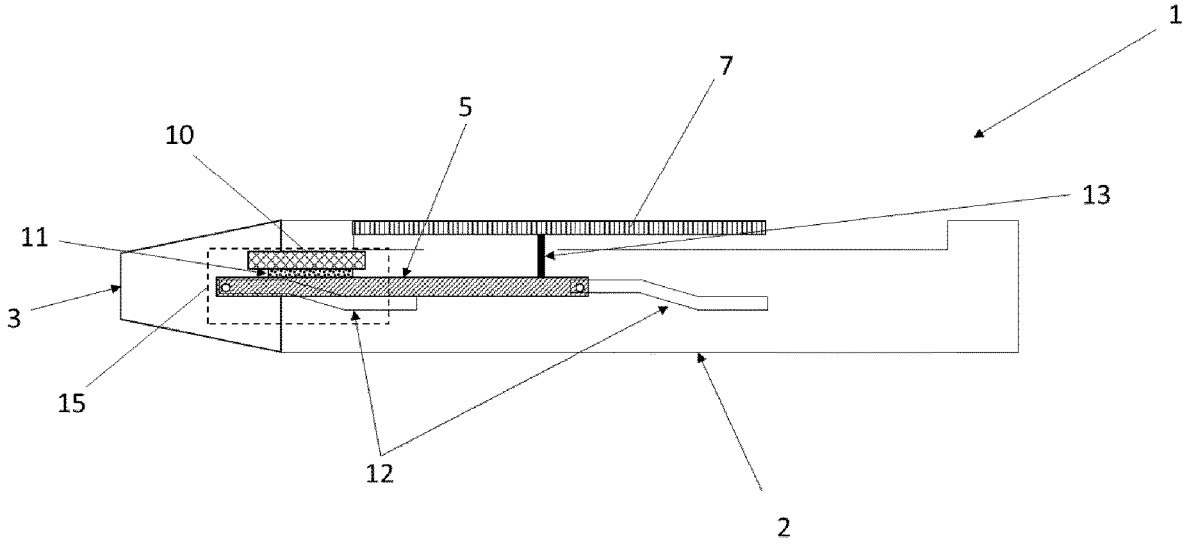
FIG. 6 shows a cross-sectional view of the aerosol generation device, with the cover in closed position.

The substrate 11 is positioned in the aerosol generation chamber 15 by inserting a tray 5 carrying the substrate 11 into the aerosol generation chamber 15. The substrate can be placed onto the tray through an aperture 4 in housing 2. When the tray 5 is inserted into the aerosol generation chamber 15, the tray 5 is guided into a position where the substrate 11 is held in the aerosol generation chamber 15, as depicted in FIG. 6. However, as shown in FIGS. 1 and 3, the tray 5 may also be in a second position, where the substrate 11 can be placed onto or removed from the tray 5.

During or after a time at which the substrate 11 is heated to generate the aerosol, air is driven towards the mouthpiece 3 to provide the aerosol to a user. In some embodiments, the air is driven by a user inhaling. In other embodiments, the aerosol generation device 1 may comprise a pump for pumping air towards the mouthpiece 3 to provide the aerosol.

Referring to FIG. 1, an aerosol generation device 1 is illustrated. The device may comprise an oblong housing 2, and a mouthpiece 3 which can be used to suck the generated aerosol out of the device. The housing has an aperture 4 which allows access to the interior of the housing. In the open position, as is illustrated in FIG. 1, said aperture is exposed, because cover 7 is in open position. A tray 5 is located underneath the aperture. The tray 5 may comprise a recess 6 or other means to fixate a substrate which may be inserted by a user. The cover 7 may be translated into the closed position by sliding it along the longitudinal direction 8 of the housing 2.

Figure 2:
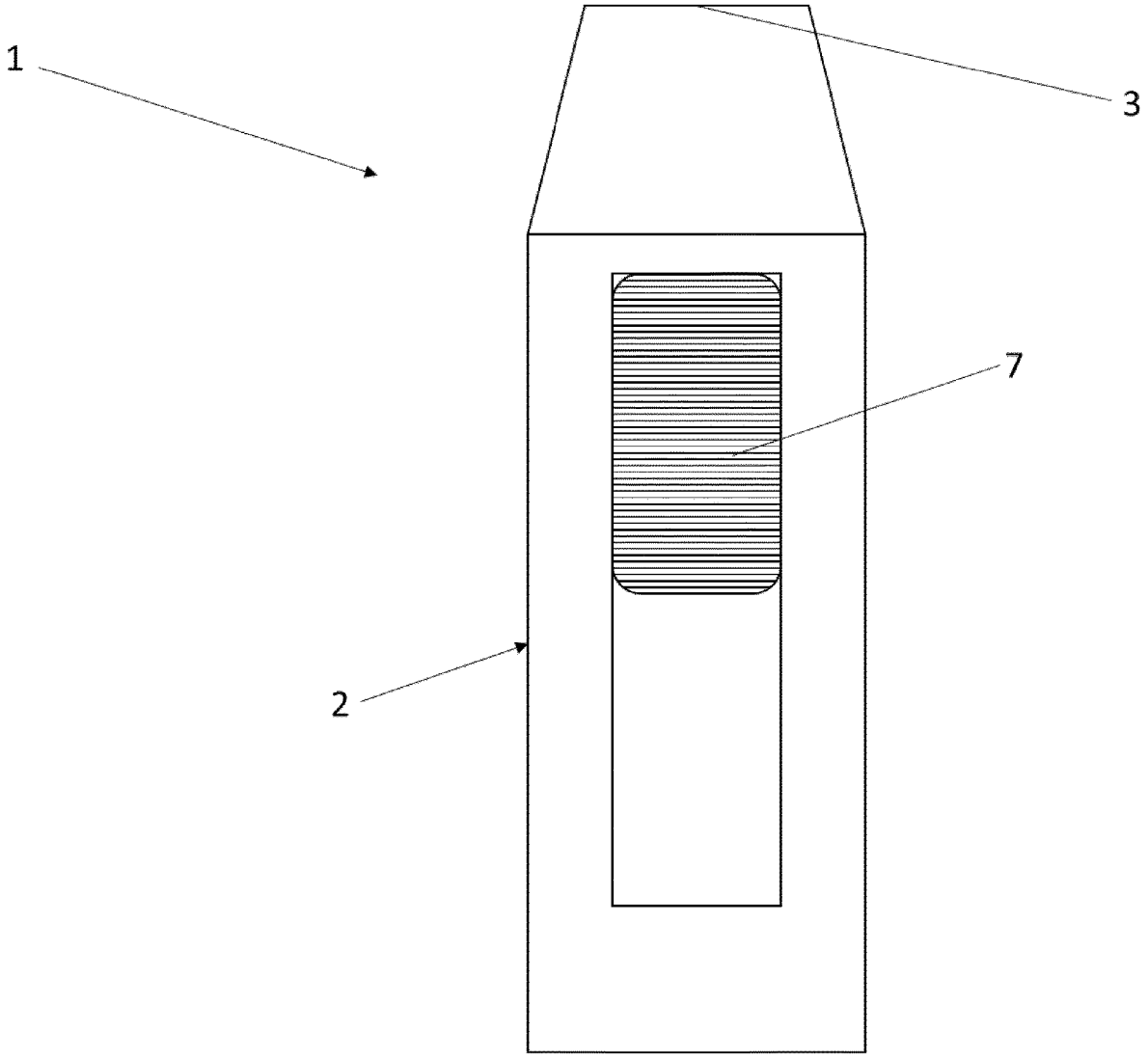
FIG. 2 shows the aerosol generation device in top view, with the cover in closed position.

FIG. 2 depicts the same embodiment of the aerosol generation device 1 as FIG. 1. However, in FIG. 2, the cover 7 is in closed position, covering the aperture 4. From the closed position, the cover can be translated back to the open position by sliding it in the opposite direction of longitudinal direction 8.

FIG. 3 depicts a cross-sectional view of the embodiment of aerosol generation device 1, with the cover 7 in open position. The tray 5 may be connected to the cover 7 by means of a connection element 13, ensuring that the tray 5 is always in a fixed position relative to the cover 7. This means that when the cover 7 is slid from the open to the closed position in the longitudinal direction 8 of the housing 2, the tray is translated in the same direction.

In some embodiments, when cover 7 and tray 5 are moved from the open position to the closed position, the tray 5 with substrate 11 moves along the guide rails 12, in which it is held by means of the bolts 14. As the bolts 14 slide along inclination portion 23, tray 5 moves parallel to inclination portion 23. Thus, in addition to the movement along longitudinal direction 8, the tray is moved in a direction perpendicular to longitudinal direction 8 and towards heating element 10. Once cover 7 and tray 5 are in closed position, substrate 11 is therefore in contact with and may be pressed against heating element 10.

The aerosol generation chamber 15 comprises one or more heating elements 10 configured to heat and generate aerosol from a substrate 11. The heating elements are preferably electric heating elements, such as resistive heating elements, but any type of heating element suitable for supplying heat to the aerosol generation chamber 15 may be used. The heating element 10 preferably has a substantially flat configuration but may have different shapes in some embodiments.

The heating element 10 may be powered by an electrical power source such as a removable battery, a rechargeable battery or the like. The electrical circuitry needed for powering the heating element is known to the skilled person and is not discussed here.

Figure 4:
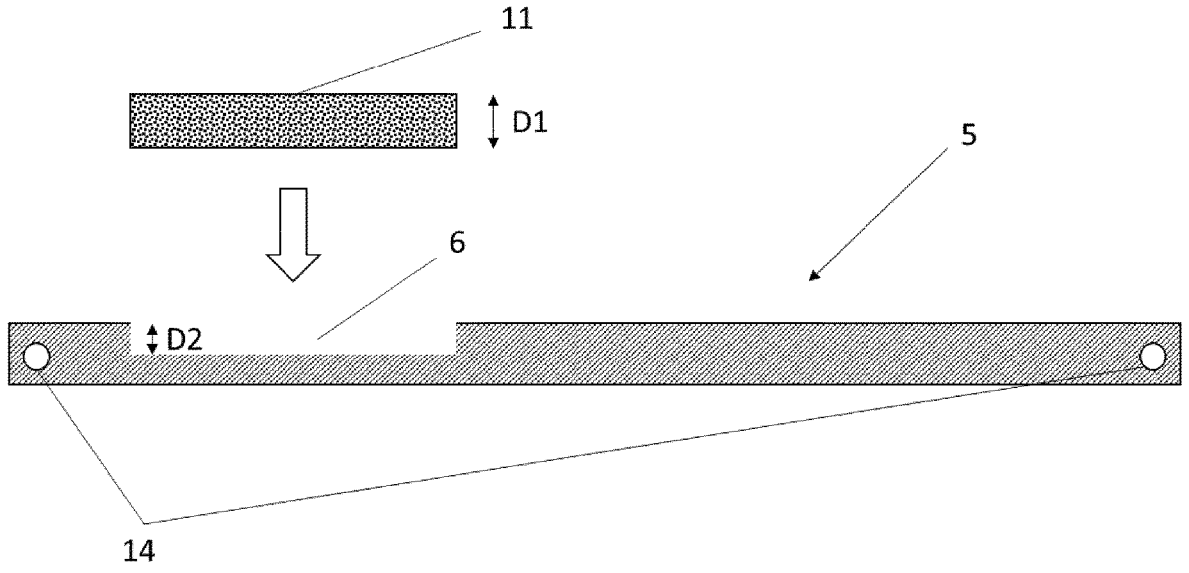
FIG. 4 shows a close-up view of a tray.

As illustrated in FIG. 4, tray 5 has a recess 6 for receiving and holding the substrate 11. A depth D2 of the recess 6 is smaller than a height D1 of the substrate 11 such that, when the substrate 11 is arranged in the recess 6, the substrate 11 partly protrudes out of the recess 6. The tray comprises bolts 14, which are longer than the width of the tray and arranged such that they project out of both sides of tray 5. In some embodiments, each bolt may be provided as merely a pair of studs projecting out of the sides of the tray. The bolts are configured to be placed inside the guide rails 12.

In some embodiments, the guide rails 12 are spaced from each other such that when the cover is in an open position, the tray 5 is placed in between the first portions 21 of guide rails 12, and when the cover is in a closed position, heating element 10 is located between the second portions 22 of guide rails 12. However, in other embodiments other spacings of the guide rails 12 are possible.

In a preferred embodiment, four guide rails 12 are provided, wherein each side portion of aerosol generation device 1 comprises two guide rails 12 which are longitudinally spaced from each other. In other embodiments, only two guide rails are provided, longitudinally spaced from each other at only one side portion or in the center of aerosol generation device 1 or at opposite side portions of aerosol generation device 1.

In yet another embodiment, only one guide rail 12 may be provided, wherein both bolts 14 may be configured to be placed in the same guide rail 12.

Figure 5:
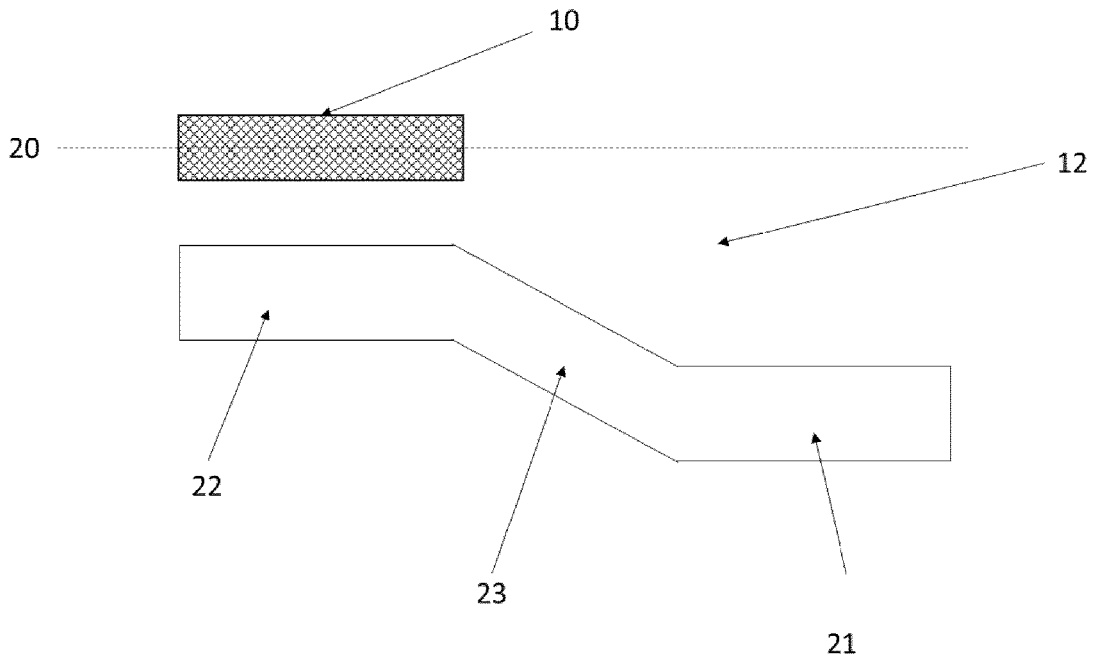
FIG. 5 shows a close-up view of a guide rail.

As illustrated in FIG. 5, the guide rails 12 have a first portion 21 and a second portion 22. The first portion 21 has a first distance to the level 20 of heating element 10, and the second portion 22 has a second distance to said level 20, the second distance of the second portion being smaller than the first distance of the first portion. I.e., the second portion 22 of guide rail 12 is closer to the level of the heating element than the first portion 21 of guide rail 12. The two portions 21 and 22 of guide rail 12 may be connected by inclination portion 23.

In some embodiments, the cover is lifted/lowered during movement between open and closed position, by means of the rigid connection element 13. However, in other embodiments, the connection element 13 is rigid in the longitudinal direction 8 but movable in a direction perpendicular to longitudinal direction 8, such as a telescopic rod or the like, with the result that cover 7 is not lifted or lowered during movement between open and closed position.

FIG. 6 illustrates the aerosol generation device 1 in a state ready to generate aerosol, where the cover 7 is in the closed position, and the substrate 11 is inside the aerosol generation chamber 15. The substrate herein is heated by heating element 10 and an aerosol can be generated. The aerosol may then be provided to a user through mouthpiece 3.

LIST OF REFERENCE SIGNS

1 Aerosol generation device
2 Housing
3 Mouthpiece
4 Aperture
5 Tray
6 Recess
7 Cover
8 Longitudinal direction
10 Heating element
11 Substrate
12 Guide rails
13 Connection element
14 Bolts
15 Aerosol generation chamber
20 Level of the heating element
21 First portion of a guide rail
22 Second portion of a guide rail
23 Inclination between portions

The invention claimed is:

1. An aerosol generation device comprising:

an aerosol generation chamber configured to receive and heat a substrate to generate aerosol, the aerosol generation chamber comprising at least a heating element;

a cover moveable between a closed position covering an aperture in the device, and an open position exposing said aperture; and a tray for receiving and holding the substrate, wherein when the cover is in the open position, the tray is located underneath the aperture such that the substrate is configured to be received by the tray or removed from the tray, and when the cover is in the closed position, the substrate received and held by the tray is contained in the aerosol generation chamber and in contact with the heating element, wherein the cover is translatable from the open position to the closed position by translating the cover over the aperture along an axial direction, whereby the tray is translated such that the substrate held by the tray is translated into the aerosol generation chamber and put in contact with the heating element, wherein the aperture is positioned on a lateral side of the aerosol generation device.

2. The aerosol generation according to claim 1, wherein the tray translates in a direction parallel to a longitudinal direction of a housing of the aerosol generation device.

3. The aerosol generation device according to claim 1, wherein the tray is connected to the cover to prevent longitudinal movement of the tray with respect to the cover, so that the translation of the cover results in the translation of the tray.

4. The aerosol generation device according to claim 3, wherein the tray is connected to the cover to prevent movement of the tray with respect to the cover in a direction perpendicular to the longitudinal movement.

5. The aerosol generation device according to claim 1, wherein the tray comprises at least two bolts configured to be placed inside a guide rail.

6. The aerosol generation device according to claim 5, wherein each of the bolts includes a pair of studs.

7. The aerosol generation device according to claim 5, wherein the bolts are placed on the tray and are longitudinally distanced from each other.

8. The aerosol generation device according to claim 5, wherein the bolts are substantially cylindrical.

9. The aerosol generation device according to claim 8, wherein a diameter of the bolts is at most thrice the thickness of the tray.

10. The aerosol generation device according to claim 1, wherein the tray is guided between the open and the closed position by a first guide rail configured to receive bolts.

11. The aerosol generation device according to claim 10, wherein the first guide rail has a first portion and a second portion, the first portion being located underneath the aperture, and the second portion being located underneath the heating element, the first portion having a first distance to the cover and the second portion having a second distance to the cover, the second distance being smaller than the first distance.

12. The aerosol generation device according to claim 11, wherein in the closed position, both bolts are located in the second portion of the first guide rail.

13. The aerosol generation device according to claim 10, further comprising a second guide rail, the second guide rail being spaced from the first guide rail in the longitudinal direction of the housing.

14. The aerosol generation device according to claim 13, wherein one bolt is placed in the first guide rail and one bolt is placed in the second guide rail.

15. The aerosol generation device according to claim 1, wherein the tray comprises a recess configured to receive and hold the substrate.

16. The aerosol generation device according to claim 7, wherein one bolt is placed before the substrate and one bolt is placed behind the substrate.

17. The aerosol generation device according to claim 9, wherein the diameter of the bolts is not more than twice the thickness of the tray.

18. The aerosol generation device according to claim 9, wherein the diameter of the bolts is less than the thickness of the tray.

19. The aerosol generation device according to claim 1, wherein the cover translates in a direction parallel to a longitudinal direction of a housing of the aerosol generation device.

* * * * *